US005350657A

United States Patent [19]

Anno et al.

[11] Patent Number: 5,350,657

[45] Date of Patent: Sep. 27, 1994

[54] TONER FOR DEVELOPING ELECTROSTATIC LATENT IMAGE

[75] Inventors: Masahiro Anno, Sakai; Makoto Kobayashi, Settsu, both of Japan

[73] Assignee: Minolta Camera Kabushiki Kaisha, Osaka, Japan

[21] Appl. No.: 968,305

[22] Filed: Oct. 29, 1992

[30] Foreign Application Priority Data

Nov. 2, 1991 [JP] Japan ..... 3-315444

[51] Int. Cl.[5] ..... G03G 9/097

[52] U.S. Cl. ..... 430/111; 430/109; 430/110

[58] Field of Search ..... 430/109, 110, 111, 903

[56] References Cited

U.S. PATENT DOCUMENTS

| | | | |
|---|---|---|---|
| 4,601,967 | 7/1986 | Suzuki et al. | 430/107 |
| 4,828,955 | 5/1989 | Kasai et al. | 430/111 |
| 4,839,255 | 6/1989 | Hyosu et al. | 430/137 |
| 4,859,560 | 8/1989 | Nakamura et al. | 430/137 |
| 4,900,647 | 2/1990 | Hikake et al. | 430/137 |
| 4,915,987 | 4/1990 | Nara et al. | 427/180 |
| 5,066,558 | 11/1991 | Hikake et al. | 430/109 |
| 5,098,811 | 3/1992 | Anno et al. | 430/110 |
| 5,219,694 | 6/1993 | Anno et al. | 430/106.6 |

OTHER PUBLICATIONS

Abstract: JP 4–295862 Oct. 20, 1992.

*Primary Examiner*—Marion E. McCamish
*Assistant Examiner*—Rosemary Ashton
*Attorney, Agent, or Firm*—Burns, Doane, Swecker & Mathis

[57] ABSTRACT

In toner for developing an electrostatic latent image, at least an organic charge-controlling agent having a BET specific surface area of 15 to 80 $m^2/g$ and inorganic fine particles having a BET specific surface area of 10 to 150 $m^2/g$ are fixed and/or film-formed on the surface of core particles mainly composed of thermoplastic resin.

15 Claims, 2 Drawing Sheets

TONER FOR DEVELOPING ELECTROSTATIC LATENT IMAGE

BACKGROUND OF THE INVENTION

1. Field of the Invention

The present invention relates generally to toner used for developing an electrostatic latent image in an image forming apparatus such as a copying machine or a printer, and more particularly, to toner in which fine particles for surface treatment such as a charge-controlling agent are fixed and/or film-formed on the surface of core particles mainly composed of thermoplastic resin.

2. Description of the Prior Art

In an image forming apparatus such as a copying machine or a printer, a variety of types of toner have been conventionally used in developing an electrostatic latent image formed on a photosensitive member.

In recent years, it has been desired to enhance the image quality of an image formed by the above-mentioned image forming apparatus. Correspondingly, it has been positively considered that toner having a small particle diameter is used.

When the toner having a small particle diameter is thus produced, it is difficult to uniformly disperse additives such as a charge-controlling agent in its toner particles, so that the additives are contained in the toner particles in an unevenly dispersed state. As a result, the chargeability or the like of the toner becomes unstable. When an image is formed using the toner, the following problems arise. For example, the image formed is fogged, and the toner is scattered from a developing device to contaminate the inside of the image forming apparatus by the toner.

In recent years, therefore, toner has been produced by fixing or film-forming fine particles for surface treatment such as a colorant or a charge-controlling agent on the surface of core particles by mechanical energy or heat energy mainly comprising an impact force.

However, a kind of charge-controlling agent is not fastened to the surface of the core particles in a uniformly dispersed state, so that the charge-controlling agent may adhere to the surface of the core particles in an unevenly dispersed state, and the charge-controlling agent may be separated from the surface of the core particles to gregate.

As a result, the toner produced in the above described manner varies in composition and characteristics. Particularly, the toner greatly varies in charge controllability, so that the chargeability or the like of the toner is still unstable. When an image is formed using the toner, the following problems still exist. For example, the image formed is fogged to lower the image quality thereof, and the toner is scattered to contaminate the inside of the image forming apparatus by the toner.

SUMMARY OF THE INVENTION

An object of the present invention is to provide toner used for developing an electrostatic latent image formed on a photosensitive member in an image forming apparatus such as a copying machine or a printer, which is produced by fixing and/or film-forming fine particles such as a charge-controlling agent on the surface of core particles mainly composed of thermoplastic resin in a uniformly dispersed state, so that it does not greatly vary in composition and characteristics, is superior in charge controllability, and is stably charged.

Another object of the present invention is to allow excellent image formation to be stably carried out using the toner without fogging an image formed and scattering of the toner to contaminate the inside of the image forming apparatus by the toner.

In the toner according to the present invention, at least an organic charge-controlling agent having a BET specific surface area of 15 to 80 $m^2/g$ and inorganic fine particles having a BET specific surface area of 10 to 150 $m^2/g$ are fixed and/or film-formed on the surface of core particles mainly composed of thermoplastic resin.

If the organic charge-controlling agent having a BET specific surface area of 15 to 80 $m^2/g$ and the inorganic fine particles having a BET specific surface area of 10 to 150 $m^2/g$ are thus used and fixed and/or film-formed on the surface of the core particles, the above-mentioned organic charge-controlling agent and the above-mentioned inorganic fine particles are fixed and/or film-formed on the surface of the above-mentioned core particles in a uniformly dispersed state even when the particle diameter of the core particles is small.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
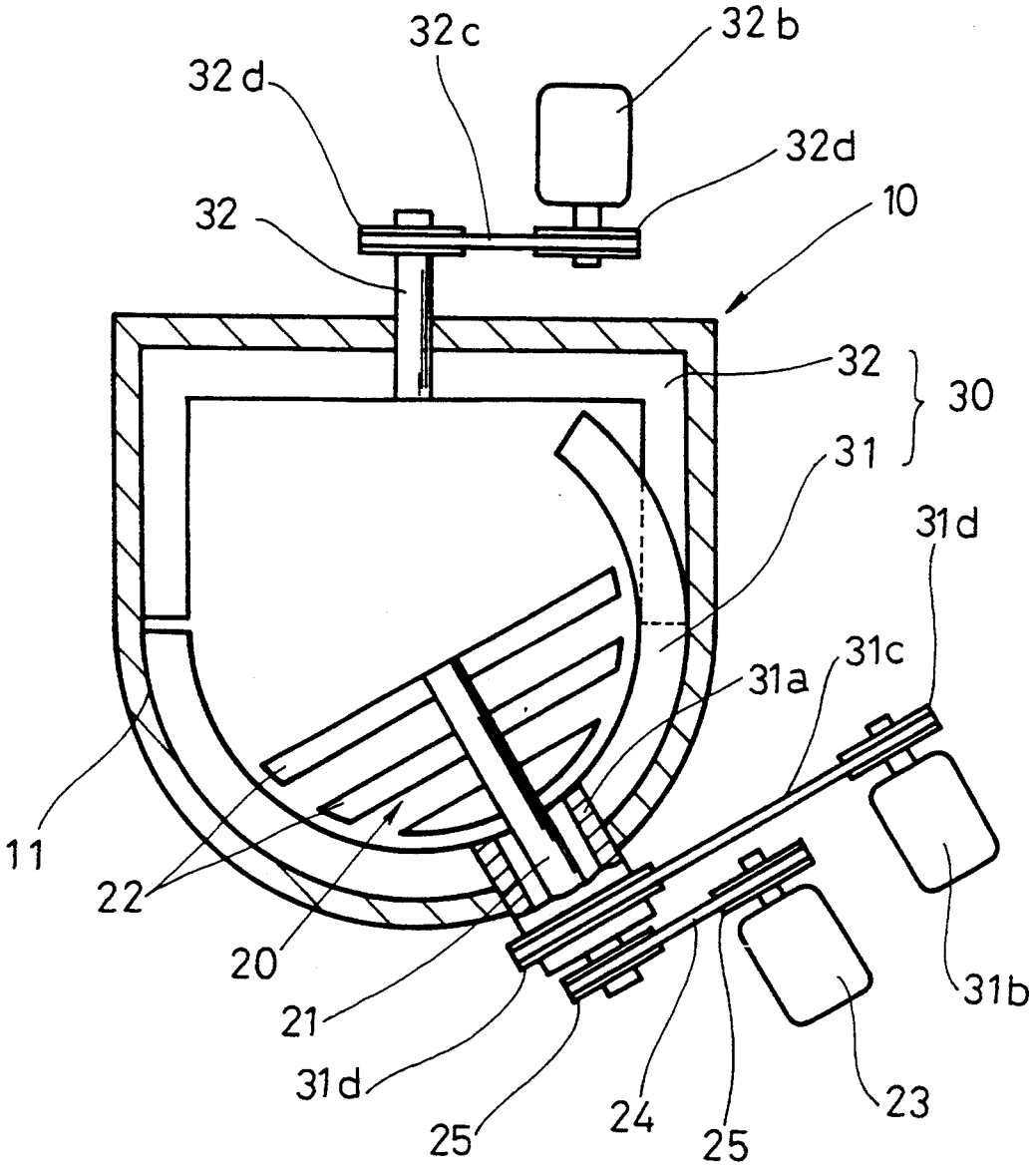
FIG. 1 is a schematic diagram for explaining a mixing equipment used for producing toner.

Toner for developing an electrostatic latent image according to the present invention will be described in detail.

In the toner according to the present invention, at least an organic charge-controlling agent having a BET specific surface area of 15 to 80 $m^2/g$ and inorganic fine particles having a BET specific surface area of 10 to 150 $m^2/g$ are fixed and/or film-formed on the surface of core particles mainly composed of thermoplastic resin.

It is possible to use, core particles produced by various known methods such as the kneading and pulverizing method, the spray drying method, and the wet granulating method which are generally used when toner is produced. Particularly, it is possible to also use core particles having a small particle diameter, on which a charge-controlling agent is not uniformly fixed and/or film-formed, obtained by the wet granulating method, and core particles having a small particle diameter of not more than 10 $\mu m$ and particularly, not more than 8 $\mu m$.

The wet granulating method for obtaining the core particles may be any known wet granulating method, for example, the granulating method including polymerization processes such as the suspension polymerization method, the emulsion polymerization method, the soap-free emulsion polymerization method, the microcapsule method (the interfacial polymerization method, the in-situ polymerization method and the like), the non-aqueous dispersion polymerization method or the granulating method including no polymerization processes such as the suspension method.

As resin used for composing the above-mentioned core particles, any resin may be generally used as binder resin when toner is produced. Examples of the resin include thermoplastic resin such as polystyrene resin, poly (meta) acrylic resin, polyolefin resin, polyamide resin, polycarbonate resin, polyether resin, polysulfone resin, polyester resin, epoxy resin and butadiene resin, or thermoserring resin such as urea resin, urethane resin and epoxy resin, their copolymers, their block polymers, their graft polymers, their polymer blends and the like. The above-mentioned resin is not limited to one in the polymeric state such as thermoplastic resin. For example, it is also possible to use one in the state of an oligomer or a prepolymer in the preceding stage of thermosetting resin, and one including a crosslinker or the like.

Furthermore, in the case of toner used in an image forming apparatus which is a high-speed system, it is necessary to fix the toner to paper or the like in a short time and improve separability from a fixing roller. Accordingly, it is preferable to use, as resin composing the above-mentioned core particles, a homopolymer or a copolymerizable polymer synthesized from a styrene monomer, a (meta) acrylic monomer or a (meta) acrylate monomer, or polyester resin.

It is desirable to use, as such resin, one having a number-average molecular weight Mn and a weight-average molecular weight Mw satisfying $1000 \leqq Mn \leqq 10000$ and $20 \leqq Mw/Mn \leqq 70$ and particularly, one having a number-average molecular weight Mn satisfying $2,000 \leqq Mn \leqq 7,000$.

Additionally, when this toner is used as toner for oilless fixing, it is desirable to use, as resin composing the core particles, one having a glass transition point of 55° to 80° C., having a softening point of 80° to 150° C. and containing 5 to 20% by weight of a gel component.

Furthermore, when the toner is used as light-transmittable color toner for full color, the abovementioned core particles require light transmission. Accordingly, it is preferable to use, as resin composing the core particles, polyester resin.

It is desirable to use, as the polyester resin composing the core particles in the light-transmittable color toner, linear polyester resin having a glass transition temperature of 55° to 70° C., having a softening point of 80° to 150° C., having a number-average molecular weight Mn of 2000 to 15000, and having a molecular-weight distribution (Mw/Mn) of not more than 3.

Furthermore, it is possible to also use, as the polyester resin, modified linear polyester obtained by reacting di-isocyanate with the above-mentioned linear polyester resin.

Used as this modified linear polyester is one mainly composed of linear polyester resin, having a glass transition temperature of 40° to 80° C. and having an acid value of not more than 5, obtained by reacting 0.3 to 0.95 mole of di-isocyanate with 1 mole of linear polyester resin composed of dicarboxylic acid and diol, having a number-average molecular weight Mn of 2000 to 15000, having an acid value of not more than 5 and substantially having as its end group a hydroxyl group.

Furthermore, it is possible to suitably use, as the above-mentioned linear polyester, one obtained by modifying a styrene monomer, an acrylic monomer, an aminoacrylic monomer and the like using processes such as graft polymerization and block polymerization and having the same glass transition temperature, the same softening point and the same molecular weight properties as those of the abovementioned modified linear polyester.

In the core particles, a colorant, an offset-preventing agent, magnetic fine particles, a charge-controlling agent or the like may be added in addition to the above-mentioned resin.

It is possible to use, as the above-mentioned colorant contained in the above-mentioned core particles, the following various types of organic or inorganic pigments and dyes in respective colors.

Examples of available black pigments include carbon black, cupric oxide, manganese dioxide, aniline black, activated carbon, non-magnetic ferrite, magnetic ferrite, magnetite and the like.

Examples of available yellow pigments include chrome yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine yellow GR, quinoline yellow lake, permanent yellow NCG, tartrazine lake and the like.

Examples of available orange pigments include chrome orange, molybdenum orange, permanent orange GTR, pyrazolone orange, vulcan orange, indanthrene brilliant orange RK, benzidine orange G, indanthrene brilliant orange GK and the like.

Examples of available red pigments include red iron oxide, cadmium red, red lead oxide, cadmium mercury sulfide, permanent red 4R, lithol red, pyrazolone red, watchung red, calcium salt, lake red C, lake red D, brilliant carmine 6B, eosine lake, rhodamine lake B, alizarin lake, brilliant carmine 3B and the like.

Examples of available purple pigments include manganese violet, fast violet B, methyl violet lake and the like.

Examples of available blue pigments include prussian blue, cobalt blue, alkali blue lake, victoria blue lake, phthalocyanine blue, metal-free phthalocyanine blue, phthalocyanine blue partial chlorine compound, fast sky blue, indanthrene blue BC and the like.

Examples of available green pigments include chrome green, chrome oxide green, pigment green B, malachite green lake, fanal yellow green G and the like.

Examples of available white pigment include zinc white, titanium oxide, antimony white, zinc sulfide and the like.

Examples of available extender pigments include powdery barytes, barium carbonate, clay, silica, white carbon, talc, alumina white and the like.

As various types of dyes such as basic dyes, acid dyes, disperse dyes and direct dyes, nigrosine, methylene blue, rose bengale, guinoline yellow, ultramarine blue and the like are available.

In containing the colorants in the core particles, the colorants can be used separately or in combination.

The content of the colorant is 1 to 20 parts by weight and preferably, 2 to 10 parts by weight per 100 parts by weight of the above-mentioned resin in the core particles because the fixing properties of the toner is lowered if the amount of the colorant is too large, while a desired image density is not obtained if the amount of the colorant is too small.

Additionally, when the above-mentioned light-transmittable color toner is used, the following various types of pigments and dyes in respective colors can be used as its colorant.

Examples of available yellow pigments for the light-transmittable color toner include C.I.10316 (naphthol yellow S), C.I.11710 (Hansa yellow 10G), C.I.11660 (Hansa yellow 5G), C.I.11670 (Hansa yellow 3G), C.I.11680 (Hansa yellow G), C.I.11730 (Hansa yellow GR), C.I.11735 (Hansa yellow A), C.I.11740 (Hansa yellow RN), C.I.12710 (Hansa yellow R), C.I.12720 (pigment yellow L), C.I.21090 (benzidine yellow), C.I.21095 (benzidine yellow G), C.I.21100 (benzidine yellow GR), C.I.20040 (permanent yellow NCG), C.I.21220 (vulcan fast yellow 5), C.I.21135 (vulcan fast yellow R) and the like.

Examples of available red pigments for the light-transmittable color toner include C.I.12055 (sterling I), C.I.12075 (permanent orange), C.I.12175 (lithol fast orange 3GL), C.I.12305 (permanent orange GTR), C.I.11725 (hansa yellow 3R), C.I.21165 (vulcan fast orange GC), C.I.21110 (benzidine orange G), C.I.12120 (permanent red 4R), C.I.1270 (para red), C.I.12085 (fire red), C.I.12315 (brilliant fast scarlet), C.I.12310 (permanent red F2R), C.I.12335 (permanent red F4R), C.I.12440 (permanent red FRL), C.I.12460 (permanent red FRLL), C.I.12420 (permanent red F4RH), C.I.12450 (light fast red toner B), C.I.12490 (permanent carmine FB), C.I.15850 (brilliant carmine 6B) and the like.

Examples of available blue pigments for the light-transmittable color toner include C.I.74100 (metal-free phthalocyanine blue), C.I.74160 (phthalocyanine blue), C.I.74180 (fast sky blue) and the like.

The colorants for the light-transmittable color toner can be used separately or in combination, similarly to the above-mentioned ordinary colorants. In addition, the content of the colorant is 1 to 10 parts by weight and preferably, 2 to 5 parts by weight per 100 parts by weight of the above-mentioned resin in the core particles because the fixing properties and the light transmittance of the toner are lowered if the amount of the colorant is too large, while a desired image density is not obtained if the amount of the colorant is too small.

Furthermore, in containing an offset-preventing agent in the above-mentioned core particles, various types of wax and particularly, polyolefin wax using low molecular weight polypropylene and polyethylene or polypropylene and polyethylene having acid groups are suitably used as such an offset-preventing agent.

It is preferable to use, as such wax, one having a number-average molecular weight Mn of 1000 to 20000 and having a softening point Tm of 80° to 150° C. The reason for this is as follows. That is, in the case of wax having a number-average molecular weight Mn of not more than 1000 or having a softening point Tm of not more than 80° C., its wax particles cannot be dispersed uniformly in the abovementioned resin composing the core particles, resulting in the eluation of the wax to the surface of the core particles. The eluation of the wax not only may yield undesired results at the time of toner preservation or development but also may cause the pollution of a photosensitive member by toner filming. On the other hand, in the case of wax having a number-average molecular weight Mn exceeding 20000 and having a softening point Tm exceeding 150° C., the compatibility of the wax with the above-mentioned resin composing the core particles is degraded and the effects such as off-set resistance at high temperature cannot be obtained.

Furthermore, when the above-mentioned resin composing the core particles has polar groups, it is desirable to use wax containing polar groups in terms of the compatibility.

Additionally, in containing magnetic fine particles in the above-mentioned core particles as magnetic toner, it is possible to use fine particles composed of a known magnetic material. For example, when black toner is obtained, magnetite (triiron tetroxide) having a black color and also functioning as a colorant can be used. On the other hand, when color toner is obtained, metallic iron or the like which is slightly blackish is used.

Typical examples of such a magnetic material include magnetic materials such as metals exhibiting ferromagnetism such as cobalt, iron and nickel, alloys of metals such as aluminum, cobalt, iron, lead, magnesium, nickel, zinc, antimony, beryllium, bismuth, cadmium, calcium, manganese, selenium, titanium, tungsten, vanadium and the like and their mixtures as well as their oxides, sintered products (ferrite) and the like.

On the other hand, in the toner according to the present invention, as an organic charge-controlling agent fixed and/or film-formed on the surface of the above-mentioned core particles, any known organic charge-controlling agent may be used, provided that its BET specific surface area is 15 to 80 $m^2/g$ as described above.

Examples of available positive charge-controlling agents include Nigrosine base EX (azine compound), Bontron N01, 02, 04, 05, 07, 09, 10, 13 (all made by Orient Kagaku Kogyo K.K.), Oil Black (made by Tyuo Gosei Kagaku K.K.), Quarternary Ammonium Salt P-51, Polyamine Compound P-52, Sudan Schwaltz BB (Solvent Black 3: Color Index No. 26150), Fett Schwaltz HBN (C.I.No. 26150), Brilliant Spirit Schwaltz TN (made by Farbenfabriken Bayer K.K.), alkoxylated amine, alkyl amide, molybdic acid chelate pigment, imidazole compound and the like. In addition, examples of available negative charge-controlling agents include azo dyes of chromium complex type of S-32, 33, 34, 35, 37, 38, 40 and 44 (made by Orient Kagaku Kogyo K.K.), Aizen Spilon Black TRH and BHH (made by Hodogaya Kagaku K.K.), Kayaset Black T-22 and 004 (made by Nihon Kayaku K.K.), Aluminum Complex Salt E-86 (made by Orient Kagaku Kogyo K.K.), Salicylic Acid Metal Complex E-81 (made by Orient Kagaku Kogyo K.K.), Calixarene Compound or the like.

The organic charge-controlling agent such as a salicylic acid metal complex or a calixarene compound which is difficult to fix and/or film-form on the surface of the above-mentioned core particles in a uniformly dispersed state can be also fixed and/or film-formed on the surface of the core particles in a uniformly dispersed state by setting its BET specific surface area to 15 to 80 $m^2/g$.

Particularly, the calixarene compound is a charge-controlling agent containing no metal and has very superior negative chargeability.

As the calixarene compound, a calix (n) arene compound as represented by the following chemical formula [1], for example, can be used.

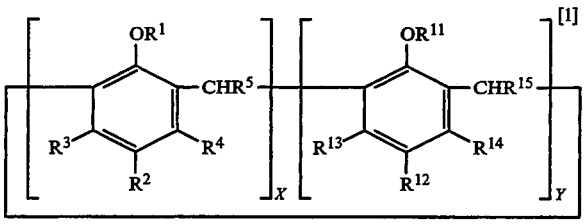

In the calix (n) arene compound represented by this general formula [1], the relationship between (n) and X and Y in the same formula is n=X+Y, where X and Y are natural numbers from 0 to 8, and n is an integer from 4 to 8.

Furthermore, in the above-mentioned general formula [1], $R^1$ represents a hydrogen atom, an alkyl group having 1 to 5 carbons, or a $-(CH_2)mCOOR^{10}$ group, where $R^{10}$ represents a hydrogen atom or a lower alkyl group and m is an integer from 1 to 8.

$R^2$ represents a hydrogen atom, a halogen atom, an alkyl group having 1 to 12 carbons which may be branched, an aralkyl group, $-NO_2$, $-NH_2$, $-N(R^7)_2$, $-SO_3R^8$, a phenyl group which may have a substituting group, or $-Si(CH_3)_3$, where $R^7$ represents a lower alkyl group and $R^8$ represents a hydrogen atom or a lower alkyl group.

$R^3$ and $R^4$ represent a hydrogen atom, a halogen atom, an alkyl group having 1 to 3 carbons, $-NH_2$, or $-N(R^9)_2$, where $R^9$ represents a lower alkyl group.

$R^5$ represents a hydrogen atom or an alkyl group having 1 to 3 carbons.

$R^{11}$ represents a hydrogen atom, an alkyl group having 1 to 5 carbons, or $-(CH_2)pCOOR^{20}$, where $R^{20}$ represents a hydrogen atom or a lower alkyl group and p is an integer from 1 to 3.

$R^{12}$ represents a hydrogen atom, a halogen atom, an alkyl group having 1 to 12 carbons which may be branched, an aralkyl group, $-NO_2$, $-NH_2$, $-N(R^{17})_2$, $-SO_3R^{18}$, a phenyl group which may have a substituting group, or $-Si(CH_3)_3$, where $R^{17}$ represents a lower alkyl group and $R^{18}$ represents a hydrogen atom or a lower alkyl group.

$R^{13}$ and $R^{14}$ represent a hydrogen atom, a halogen atom, an alkyl group having 1 to 3 carbons, $-NH_2$, or $-N(R^{19})_2$, where $R^{19}$ represents a lower alkyl group.

$R^{15}$ represents a hydrogen atom or an alkyl group having 1 to 3 carbons.

In fixing and/or film-forming the organic charge-controlling agent on the core particles, sufficient chargeability cannot be provided to the toner if the amount of the organic charge-controlling agent is too small, while the amount of the organic charge-controlling agent liberated without being fixed and/or film-formed on the surface of the core particles is increased so that the toner is degraded, for example, if the amount thereof is too large. Accordingly, 0.01 to 10 parts by weight and preferably, 0.05 to 2 parts by weight and more preferably, 0.1 to 1 parts by weight of such an organic charge-controlling agent is generally added to 100 parts by weight of the core particles.

Furthermore, in fixing and/or film-forming the organic charge-controlling agent on the core particles, if the particle diameter of this organic charge-controlling agent is large, the organic charge-controlling agent does not easily adhere to the surface of the core particles uniformly. Accordingly, it is preferable to use one having a particle diameter of 0.01 to 1 μm.

The organic charge-controlling agent can be also contained in the core particles. In thus containing the organic charge-controlling agent in the core particles, the amount of the organic charge-controlling agent should be suitably selected and determined depending on the amount of the organic charge-controlling agent fixed and/or filmformed on the surface of the core particles, the type of resin used for the core particles, the type of additives contained in the core particles, a developing system using the toner (a two-component system or a single component system), or the like.

Furthermore, as the inorganic fine particles fixed and/or film-formed on the surface of the core particles together with the organic charge-controlling agent, any known inorganic fine particles conventionally used in the production of toner may be used, provided that its BET specific surface area is within the range of 10 to 150 $m^2/g$ as described above. For example, it is possible to use various non-magnetic inorganic fine particles produced using the dry process or the wet process, for example, various carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carborundum; various nitrides such as boron nitride, titanium nitride and zirconium nitride; borides such as zirconium boride; various oxides such as iron oxide, chromium oxide, titanium oxide, calcium oxide, magnesium oxide, zinc oxide, copper oxide, aluminum oxide, silica, colloidal silica and hydrophobic silica; sulfides such as molybdenum disulfide; fluorides such as magnesium fluoride and carbon fluoride; various types of metal soap such as aluminum stearate, calcium stearate, zinc stearate and magnesium stearate; talc, and bentonite.

If the inorganic fine particles having a BET specific surface area in the range of 10 to 150 $m^2/g$, the organic charge-controlling agent is uniformly dispersed by the presence of the inorganic fine particles, to be fixed and/or film-formed on the surface of the core particles.

It is desirable to coat the surface of the above-mentioned inorganic fine particles with alkyl polysiloxane or the like to make the inorganic fine particles hydrophobic. If the surface of the inorganic fine particles is thus coated with alkyl polysiloxane or the like to make the inorganic fine particles hydrophobic, the organic charge-controlling agent is satisfactorily dispersed by the presence of the inorganic fine particles. Even when the organic charge-controlling agent such as a salicylate metal complex or a calixarene compound which is difficult to fix and/or film-form on the surface of the core particles in a uniformly dispersed state is used, therefore, the organic charge-controlling agent can be fixed and/or film-formed on the surface of the core particles in a uniformly dispersed state.

Furthermore, if the particle diameter of the above-mentioned inorganic fine particles is large, it is difficult to fix and/or film-form the organic charge-controlling agent on the surface of the core particles in a uniformly dispersed state. Accordingly, as the inorganic fine particles, ones usually having an average particle diameter of 0.001 to 1 μm and preferably, 0.02 to 0.5 μm are used.

Additionally, the effect of dispersion on the organic charge-controlling agent is lost if the amount of the abovementioned inorganic fine particles is small, while the fixing properties of the toner is degraded and a photosensitive member is damaged if the amount thereof is too large. Accordingly, 0.01 to 10 parts by weight and preferably, 0.1 to 2 parts by weight and more preferably, 0.5 to 1 parts by weight of the inorganic fine particles are usually added to 100 parts by weight of the core particles.

It is desirable that the relationship between the BET specific surface areas of the above-mentioned inorganic fine particles and the organic charge-controlling agent satisfies $\frac{1}{3} \leqq (B)/(A) \leqq 5$ when (A) is taken as the BET specific surface area of the organic charge-controlling agent and (B) is taken as the BET specific surface area of the inorganic fine particles.

The reason for this is that if (B)/(A) is less than $\frac{1}{3}$, the inorganic fine particles cannot cause the organic charge-controlling agent to be sufficiently dispersed, so that the inorganic fine particles adhere to the surface of the core particles in large amounts, resulting in the degradation of the chargeability of the obtained toner. On the other hand, if (B)/(A) is more than 5, not only the surface of the core particles but also the surface of the organic charge-controlling agent is coated with the inorganic fine particles, so that the organic charge-controlling agent is not satisfactorily dispersed on the surface of the core particles, and the improvement of the chargeability of the obtained toner by the fixing of the organic charge-controlling agent is prevented by the presence of the inorganic fine particles, resulting in the degradation of the chargeability of the toner.

Additionally, the chargeability of the toner is degraded if the amount of the organic charge-controlling agent is small, while the organic charge-controlling agent is not uniformly fixed and/or film-formed on the surface of the core particles so that the chargeability varies if the amount of the organic charge-controlling agent is too large. Accordingly, the inorganic fine particles and the organic charge-controlling agent are generally added in the weight ratio of $\frac{1}{4}$ to 4 and preferably, $\frac{1}{2}$ to 3/2.

In fixing and/or film-forming the organic charge-controlling agent and inorganic fine particles on the surface of the above-mentioned core particles to produce the toner, it is possible to suitably employ devices such as Hybridization System to which the impact process in a high speed current is applied (made by Nara Kikai Seisakusyo K.K.), Cosmos System (made by Kawasaki Heavy Industries, Ltd.), PJM (Nippon Pnewmatic Kogyo K.K.), Cryptron System (made by Kawasaki Heavy Industries, Ltd.), Mechanofusion System to which the dry mechanochemical process is applied (made by Hosokawa Mikuron K.K.), Mechanomill (made by Okada Seiko K.K.), Surfusing System to which the modification process in a hot air current is applied (made by Nippon Pnewmatic Kogyo K.K.), Dispacoat to which the wet coating process is applied (made by Nisshin Flour Milling Co., Ltd.), and Coatmizer (made by Freund Industrial Co., Ltd.). However, the present invention is not particularly limited to toner produced by the devices.

When the organic charge-controlling agent and the inorganic fine particles are fixed on the surface of the core particles, one or a plurality of other particles may be used together with the organic charge-controlling agent and the inorganic fine particles. It is possible to use, as the above-mentioned particles which are not softened, thermoplastic resin particles, various metal particles, ceramic particles and the like.

Furthermore, when the organic charge-controlling agent and the inorganic fine particles are film-formed on the surface of the core particles, it is possible to use one or a plurality of other particles together with the organic charge-controlling agent and the inorganic fine particles.

The above-mentioned particles are softened so as to cover the surface of the core particles.

The organic charge-controlling agent and the inorganic fine particles are dispersed in a layer formed by the softened particles.

It is possible to use, as the above-mentioned particles which are softened, particles composed of various types of thermoplastic resin such as styrene resin, (meta) acrylic resin, olefin rein, polyester resin, amide resin, carbonate resin, polyether and polysulfone, their copolymers and their polymer blends, and the like.

Furthermore, the resin composing the above-mentioned particles which are softened may be resin identical to or different from the resin composing the core particles. In order to provide heat resistance higher than that of the core particles, however, one having a glass transition temperature of not less than 50° C. and higher than that of the resin composing the core particles is preferably used.

Additionally, it is desirable that the amount of the thermoplastic resin particles used as the particles which are softened is a maximum of 50 parts by weight and preferably, 5 to 30 parts by weight per 100 parts by weight of the core particles in one treatment. The reason for this is that it is difficult to uniformly form a layer on the surface of the core particles so that the organic charge-controlling agent and the inorganic fine particles are not satisfactorily dispersed on the surface of the core particles if the amount of the above-mentioned thermoplastic resin particles is less than 5 parts by weight, while there is a possibility that a stable layer cannot be formed if the amount thereof exceeds 50 parts by weight.

Generally, the organic charge-controlling agent and the inorganic fine particles may, in some cases, aggregate. Accordingly, it is preferable that the organic charge-controlling agent and the inorganic fine particles are previously brought into fine particles, to be crushed to the state of primary particles.

In bringing the organic charge-controlling agent and the inorganic fine particles into fine particles, it is possible to use known processes such as the dry and wet processes. Specifically, it is possible to suitably employ various dry jet grinders, wet grinders such as a sand mill, and the like.

When the organic charge-controlling agent and the inorganic fine particles are crushed under the wet state and are dried to be used as powder, it is possible to employ an instantaneous drying equipment (Cracks System made by Hosokawa Mikuron K.K.) and the like.

Furthermore, a fluidizing agent can be added to the toner obtained in the above described manner so as to enhance its fluidity. As such a fluidizing agent, silica, aluminum oxide, titanium oxide, magnesium fluoride and the like can be used separately or in combination.

Additionally, in order to, for example, improve the fluidity of the toner according to the present invention and allow the toner to be easily stripped from the photosensitive member, the organic fine particles may be caused to adhere or fixed to the surface of the toner. As such organic fine particles, various organic fine particles such as styrene (meta) acryl, benzoguanamine, melamine, Teflon, silicon, polyethylene, polypropylene, acrylic fluoride and vinylidene fluoride which are granulated by, for example, wet polymerization processes such as the emulsion polymerization and the non-aqueous dispersion polymerization process, the gas phase process and the like can be used separately or in combination.

Furthermore, the toner according to the present invention can be also used as a two-component developing agent by mixing with magnetic carriers.

As the magnetic carries mixed with the toner according to the present invention, it is possible to use known magnetic carriers conventionally commonly used. Examples of the magnetic carriers include carriers composed of magnetic materials such as alloys or mixtures of metals such as iron, nickel and cobalt and metals such as zinc, antimony, aluminum, lead, tin, bismuth, beryllium, manganese, selenium, tungsten, zirconium and vanadium, mixtures of metals such as iron, nickel and cobalt and metal oxides such as titanium oxide and magnesium oxide, mixtures of metals such as iron, nickel and cobalt and nitrides such as chromium nitride and vanadium nitride, and mixtures of metals such as iron, nickel and cobalt and carbides such as silicon carbide and tungsten carbide, and ferromagnetic ferrite, as well as their mixtures.

Furthermore, it is possible to use, as the abovementioned magnetic carriers, carriers using iron, ferrite or the like as a core material whose surface is coated with various types of synthetic resin or a ceramic layer.

Examples of the above-mentioned synthetic resin for coating the core material include various types of thermoplastic and thermosetting resin such as polystyrene resin, poly (meta) acrylic resin, polyolefin resin, polyamide resin, polycarbonate resin, polyether resin, polysulfone resin, polyester resin, epoxy resin, polybutyral resin, urea resin, urethane/urea resin, silicone resin, polyethylene resin and Teflon resin, and their mixtures, as well as their copolymers, block polymers, graft polymers, polymer blends and the like. In addition, resin having various polar groups may be used so as to improve the chargeability. On the other hand, in coating the surface of the above-mentioned core material with the ceramic layer, the surface of the core material is coated with various ceramic materials using processes such as the hot spray coating process, various plasma processes, and the sol-gel process. Furthermore, carries coated with polyethylene by the surface polymerization process described in Japanese Patent Laid-Open Gazette No. 106808/1985 can be also suitably used.

Furthermore, as the above-mentioned magnetic carriers, binder type carriers so regulated as to have a required particle diameter obtained by using as binder resin the above-mentioned various types of synthetic resin used for coating, adding the above-mentioned various magnetic materials and various organic and/or inorganic materials as required to the binder resin, and mixing, kneading and pulverizing them may be used.

Meanwhile, the above-mentioned various magnetic carriers used in the present invention have the disadvantages in that the magnetic carriers themselves generally adhere to the photosensitive member to be developed if the particle diameter thereof is less than 20 μm, while an image formed generally becomes rough if the particle diameter thereof is more than 200 μm. Accordingly, magnetic carriers having an average particle diameter of 20 to 200 μm and preferably, 30 to 100 μm are generally used. Magnetic carriers having a suitable particle diameter may be suitably selected and used depending on the developing system or the like.

The toner according to the present invention will be specifically described. The toner in examples according to the present invention is compared with toner in comparative examples which do not satisfy the conditions of the present invention, to reveal that the toner according to the present invention is superior.

EXAMPLE 1

In this example, 100 parts by weight of styrene-n-butyl methacrylate (having a softening point of 132° C. and having a glass transition point of 60° C.), 8 parts by weight of carbon black (MA#8 made by Mitsubishi Chemical Industries, Ltd.) and 5 parts by weight of low molecular weight polypropylene (Biscole 550P made by Sanyo Kasei K.K.) were sufficiently mixed by a ball mill and then the resulting mixture was kneaded by a three-roll mill heated at 140° C. The kneaded mixture was left to stand to be cooled and then roughly pulverized by a feather mill, and furthermore by finely pulverized by a jet mill. Subsequently, the resulting particles were subjected to air classification to obtain core particles having an average particle diameter of 6 μm.

On the other hand, as an organic charge-controlling agent, an azo dye of chromium complex type (Bontron S-34 made by Orient Kagaku Kogyo K.K.) was used, which was pulverized in a n-hexane medium by a sand mill (Paint Conditioner made by Red Devil K.K.) and then was dried by an instantaneous vacuum drying equipment (Cracks System made by Hosokawa Micron K.K.).

The BET specific surface area of the organic charge-controlling agent thus obtained was 18 $m^2/g$ and the particle diameter thereof was 0.8 μm.

Furthermore, as inorganic fine particles, together with the organic charge-controlling agent, titanium dioxide fine particles was used, which was obtained by spray coating 100 parts by weight of hydrophilic titanium oxide (P-25 made by Nippon Aerozil K.K.) with a solution of 5 parts by weight of alkyl polysiloxane represented by the following chemical formula [2] diluted with 50 parts by weight of xylene, followed by drying, heat treatment at 150° C. for two hours.

[2]

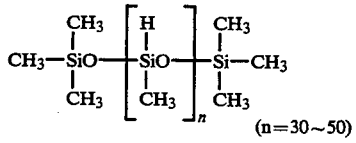

The BET specific surface area of the inorganic fine particles comprising the above-mentioned titanium dioxide fine particles was 43 $m^2/g$, and the particle diameter thereof was 0.025 μm.

In fixing the above-mentioned organic charge-controlling agent and the above-mentioned inorganic fine particles on the surface of the above-mentioned core particles, 1.0 part by weight of the organic charge-controlling agent and 0.5 parts by weight of the inorganic fine particles were first added to 100 parts by weight of the core particles, and they were mixed and agitated using a mixing equipment shown in FIG. 1.

In the mixing equipment shown in FIG. 1, the lower part of a treating chamber 10 for mixing and agitating the abovementioned respective particles is formed in a hemispherical shape, while the upper part thereof is formed in a cylindrical shape, agitating means 20 for mixing and agitating the respective particles in the treating chamber 10 has a plurality of agitating blades 22 provided for a rotating shaft 21, the above-mentioned rotating shaft 21 is inclined at a suitable angle from the hemispherical lower part of the treating chamber 10 to lead into the treating chamber 10, and the above-mentioned agitating blades 22 provided for the rotating shaft 21 are held in a state where they are inclined at a suitable angle in the treating chamber 10.

The rotating shaft 21 is rotated by a motor 23 through a belt 24 and a pulley 25, so that the above-mentioned agitating blades 22 are rotated in a state where they are inclined at a required angle in the treating chamber 10, to mix and agitate the above-mentioned respective particles by the agitating blades 22 thus rotated in the treating chamber 10.

Furthermore, in this mixing equipment, as adhesion restraining means 30 for restraining the respective particles from adhering to an internal wall 11 of the above-mentioned treating chamber 10, a first scrapping member 31 in a circular arc shape corresponding to an internal shape of the lower part of the treating chamber 10 is attached to a cylindrical rotating shaft 31*a* into which the rotating shaft 21 of the above-mentioned agitating means 20 is inserted, the first scrapping member 31 being brought into close contact with the inner wall 11 of the lower part of the treating chamber 10, and a second scrapping member 32 in a groove shape corresponding to an internal shape of the upper part of the treating chamber 10 is attached to a rotating shaft 32*a* extending into the treating chamber 10 from above the treating chamber 10, the second scrapping member 32 being brought into close contact with the inner wall 11 of the upper part of the treating chamber 10.

The rotating shaft 31*a* to which the above-mentioned first scrapping member 31 is attached is rotated by a motor 31*b* through a belt 31*c* and a pulley 31*d* to rotate the first scrapping member 31 in close contact with the inner wall 11 of the lower part of the treating chamber 10, and the rotating shaft 32*a* to which the above-mentioned second scrapping member 32 is attached is rotated by a motor 32*b* through a belt 32*c* and a pulley 32*d* to rotate the second scrapping member 32 in close contact with the inner wall 11 of the upper part of the treating chamber 10, thereby to scrap the particles adhering to the inner wall 11 of the lower part and the upper part of the treating chamber 10 away from the inner wall 11 of the treating chamber 10 by the respective scrapping members 31 and 32.

In mixing and agitating the above-mentioned respective particles by this mixing equipment, the above-mentioned respective agitating blades 22 are rotated by the abovementioned rotating shaft 21 in such a manner that the peripheral speed in ends of the largest agitating blade 22 out of the agitating blades 22 is 60 m/sec, and the abovementioned first and second scrapping members 31 and 32 are respectively rotated at suitable rotational speeds in such a manner as to be rotated in the forward direction and the reverse direction with respect to the direction of rotation of the agitating blades 22 for every 10 seconds, to mix and agitate the particles by the respective agitating blades 22 for two minutes while preventing the respective particles from adhering to the inner wall of the treating chamber 20 to aggregate.

If the above-mentioned respective particles are thus mixed and agitated, the particles do not adhere to the inner wall 11 of the treating chamber 10 to aggregate. Accordingly, the above-mentioned organic charge-controlling agent and the above-mentioned inorganic fine particles were crushed to the state of primary particles and were mixed with the above-mentioned core particles in a sufficiently dispersed state, so that the organic charge-controlling agent and the inorganic fine particles in the state of primary particles adhered to the surface of the core particles in a uniformly dispersed state.

Furthermore, in this mixing equipment, the agitating blades 22 are rotated in a state where they are inclined at a required angle in the treating chamber 10 as described above. Accordingly, in mixing and agitating the respective particles by the agitating blades 22, the stress applied to the respective particles was reduced.

After the above-mentioned core particles, the organic charge-controlling agent and the inorganic fine particles were thus mixed with each other, their mixture was subjected to fixing treatment at a peripheral speed of 60 m/sec using Hybridization System (NHS-O type made by Nara Kikai Seisakusho K.K.), to fix the organic charge-controlling agent and the inorganic fine particles on the surface of the core particles.

0.1 parts by weight of hydrophobic silica having an average particle diameter of 0.017 μm (R-974 made by Nippon Aerozil K.K.) was added to 100 parts by weight of a treated product obtained by fixing the organic charge-controlling agent and the inorganic fine particles to the surface of the core particles, and they were treated for one minute at 1000 rpm by Henschel Mixer (made by Mitui Miike Kakoki K.K.), to produce toner.

COMPARATIVE EXAMPLE

In this comparative example, toner was produced in the same manner as the above-mentioned example 1 except that only the organic charge-controlling agent used in producing the toner in the example 1 was changed.

In this comparative example, as an organic charge-controlling agent, the above-mentioned azo dye of chromium complex type (Bontron S-34 made by Orient Kagaku Kogyo K.K.) was used without being subjected to the treatment in the example 1.

The BET specific surface area of the organic charge-controlling agent was 10 $m^2/g$, and the particle diameter thereof was 3.6 μm.

EXAMPLE 2

In this example, toner was produced in the same manner as the above-mentioned example 1 except that the organic charge-controlling agent and the inorganic fine particles used in producing the toner in the example 1 were changed.

In this example, as an organic charge-controlling agent, p-tert-butyl calix (8) arene represented by the following chemical formula [3] where a is $-C(CH_3)_3$ was used, which was pulverized by a jet grinder.

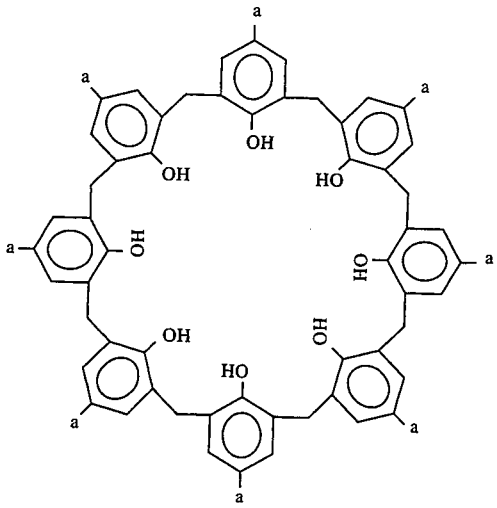

[3]

The BET specific surface area of the organic charge-controlling agent thus obtained was 27 $m^2/g$, and the particle diameter thereof was 0.8 μm.

Furthermore, as inorganic fine particles, silica fine particles were used, which were obtained by spray coating 100 parts by weight of hydrophilic silica fine particles (OX-50 made by Nippon Aerozil K.K.) with a solution of 5 parts by weight of alkyl polysiloxane represented by the following chemical formula [4] diluted with 50 parts by weight of xylene, followed by drying, heat treatment at 150° C. for two hours.

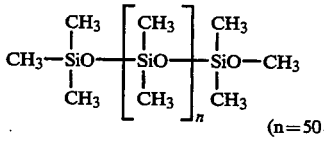

[4]

The BET specific surface area of the inorganic fine particles comprising the above-mentioned silica fine particles thus obtained was 42 $m^2/g$, and the particle diameter thereof was 0.05 μm.

COMPARATIVE EXAMPLE 2

In this comparative example, toner was produced in the same manner as the above-mentioned example 2 except that only the inorganic fine particles used in producing the toner in the example 2 was changed.

In this comparative example, as inorganic fine particles, hydrophobic silica (Tullanox 500 made by Gunze Limited) treated by dimethyldichlorosilane was used. The BET specific surface area of the inorganic fine particles were 225 $m^2/g$, and the particle diameter thereof was 0.007 μm.

EXAMPLE 3

In this example, 100 parts by weight of styrene, 35 parts by weight of n-butyl methacrylate, 5 parts by weight of methacrylic acid, 0.5 parts by weight of 2,2-azobis-(2, 4-dimethylvaleronitrile), 3 parts by weight of low molecular weight polypropylene (Biscole 605P made by Sanyo Kasei Kogyo K.K.), and 8 parts by weight of carbon black (MA#8 made by Mitsubishi Chemical Industries, Ltd.) were mixed with each other using a sand stirrer, to regulate a polymeric composition.

The polymeric composition was put into a 3 percent gum arabic solution and was subjected to polymerization reaction at 60° C. for six hours while being agitated at 4000 rpm using an agitator (TK Auto Homomixer made by Tokusyu Kika Kogyo K.K.), to obtain spherical core particles having an average particle diameter of 6 μm.

On the other hand, as an organic charge-controlling agent, one obtained by grinding a zinc salicylate metal complex represented by the following chemical formula [5] using a jet grinder was used.

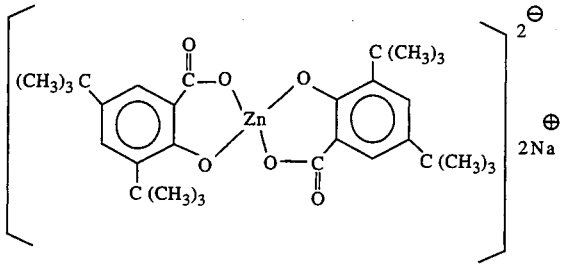

The BET specific surface area of the organic charge-controlling agent thus obtained was 48 $m^2/g$, and the particle diameter thereof was 0.4 μm.

Furthermore, as inorganic fine particles, the same inorganic fine particles as that used in the above-mentioned example 1 was used.

The above-mentioned organic charge-controlling agent and the above-mentioned inorganic fine particles were added in the weight ratio of 1:1 to a medium containing water and methanol in the weight ratio of 80:20, and were previously ground in this medium using a sand mill (Paint Conditioner made by Red Devil K.K.).

A mixture of the organic charge-controlling agent and the inorganic fine particles thus ground was added to a dispersed system of the above-mentioned core particles in a proportion of 3 parts by weight to 100 parts by weight of a solid content of the core particles and then, continued to be agitated, to fix the organic charge-controlling agent and the inorganic fine particles on the surface of the core particles.

Thereafter, a treated product obtained was repeatedly filtered and rinsed and then, cake-shaped particles obtained were dried at 80° C. for five hours using a hot-air dryer to aggregate. Particularly, ultrafine particles having a particle diameter of not more than 1 μm were fixed on the surface of particles having a particle diameter of not less than 3 μm and fused into particles having a particle diameter of approximately 50 μm to 1 mm, to obtain an aggregate having an average particle diameter of approximately 100 μm to 2 mm.

The aggregate thus obtained was then separated each particles forming the aggregate at 10000 rpm by Cryptron System (KTM-X type made by Kawasaki Heavy Industries, Ltd.) and was subjected to surface modification treatment.

0.2 parts by weight of hydrophobic silica (H-2000 made by Waker K.K.) was added to 100 parts by weight of the above-mentioned particles, and they were treated at 1000 rpm for one minutes using Henschel Mixer (made by Mitui Miike Kakoki K.K.), to produce toner.

COMPARATIVE EXAMPLE 3

In this comparative example, toner was produced in the same manner as the above-mentioned example 3 except that the organic charge-controlling agent and the inorganic fine particles used in the example 3 were changed.

In this comparative example, as an organic charge-controlling agent, one obtained by grinding p-tert-butyl calix (8) arene using a jet grinder was used, as in the above-mentioned example 2.

Furthermore, as inorganic fine particles, silica fine particles obtained by treating monodisperse silica fine particles (KE-P50 made by Nihon Shokubai K.K.) with alkyl polysiloxane were used. The BET specific surface area of the inorganic fine particles was 8 $m^2/g$, and the particle diameter thereof was 0.5 $\mu m$.

EXAMPLE 4

In this example, toner was produced in the same manner as the above-mentioned example 3 except that the organic charge-controlling agent and the inorganic fine particles used in producing the toner in the example 3 were changed.

In this example, as an organic charge-controlling agent, an organic charge-controlling agent having a BET specific surface area of 18 $m^2/g$ and having a particle diameter of 0.8 $\mu m$ obtained by considerably grinding quaternary ammonium salt (TP-302 made by Hodogaya Kagaku Kogyo K.K.) using a jet grinder was used.

Furthermore, as inorganic fine particles, aluminum oxide fine particles were used, which were obtained by spray coating 100 parts by weight of hydrophilic aluminum oxide (Aluminium Oxide C made by Nippon Aerozil K.K.) with a solution of 5 parts by weight of dimethyl silicone represented by a structural formula $C_8F_{17}SO_2NC_2H_5(CH_2)_3Si(OC_2H_5)_3$ diluted with 50 parts by weight of xylene, followed by drying, heat treatment at 150° C. for two hours, and coating with dimethyl silicone.

The BET specific surface area of the inorganic fine particles comprising aluminum oxide fine particles thus obtained was 82 $m^2/g$, and the particle diameter thereof was 0.02 $\mu m$.

COMPARATIVE EXAMPLE 4

In this comparative example, toner was produced in the same manner as the above-mentioned example 4 except that only the organic charge-controlling agent used in producing the toner in the example 4 was changed.

In this comparative example, as an organic charge-controlling agent, quaternary ammonium salt (TP-302 made by Hodogaya Kagaku Kogyo K.K.) used in the above-mentioned example 4 was used without being ground using a jet grinder.

The BET specific surface area of the organic charge-controlling agent was 13 $m^2/g$, and the particle diameter thereof was 2.8 $\mu m$.

EXAMPLE 5

In this example, 100 g of polyester resin (NE-382 made by Kao K.K.) was dissolved in 400 g of a mixed solvent of methylene chloride and toluene (8:2), 5 g of a phthalocyanine pigment was added to a solution obtained, and they were mixed with each other in a ball mill four three hours, to obtain uniform mixed dispersion.

60 g of a 4 percent solution of methyl cellulose (Metocell K35LV made by Daw Chemical Ltd.), 5 g of a 1 percent solution of dioctyl sulfosuccinate soda (Nicole OTP75 made by Nikko Chemical K.K.) and 0.5 g of hexametaphosphoric acid soda (Wako Jyunyaku K.K.) were then dissolved in 1000 g of ion-exchange water, to obtain a solution serving as a dispersion stabilizing agent. The above-mentioned uniform mixed dispersion was added to the solution, and was so suspended in the solution as to have an average particle diameter of 3 to 10 $\mu m$ by adjusting the rotational speed using TK Auto Homomixer (made by Tokusyu Kika Kogyo K.K.).

Thereafter, the dispersion in the solution was further agitated at the reduced speed to remove the mixed solvent of methylene chloride and toluene at 60° C. in five hours, thereby to obtain spherical core particles having an average particle diameter of 6 $\mu m$.

On the other hand, as an organic charge-controlling agent, an organic charge-controlling agent composed of the same zinc salicylate metal complex as that used in the above-mentioned example 3 was used. In addition, as inorganic fine particles, titanium oxide fine particles subjected to surface treatment with the same alkyl polysiloxane as that used in the above-mentioned example 1 was used.

The above-mentioned organic charge-controlling agent and the above-mentioned inorganic fine particles were added in the weight ratio of 1:1 to a medium containing water and methanol in the weight ratio of 80:20, and they were previously ground in the medium using a sand mill (Paint Conditioner made by Red Devil K.K.).

A mixture of the organic charge-controlling agent and the inorganic fine particles thus ground was added to a dispersed system of the above-mentioned core particles in a proportion of 3 parts by weight to 100 parts by weight of a solid content of the core particles and then, continued to be agitated, to fix the organic charge-controlling agent and the inorganic fine particles to the surface of the core particles.

Thereafter, this dispersion was dried using Disper Coat which is a slurry drying equipment, and the organic charge-controlling agent and the inorganic fine particles were fixed to the surface of the core particles, to obtain cyan particles having an average particle diameter of 5.5 $\mu m$.

0.2 parts by weight of hydrophobic silica (H-2000 made by Wakker K.K.) was then added to 100 parts by weight of the cyan particles thus obtained, and they were treated at 1000 rpm for one minute by Henschel Mixer (made by Mitui Miike Kakoki K.K.), to produce toner.

COMPARATIVE EXAMPLE 5

In this comparative example, toner was produced in the same manner as the above-mentioned example 5 except that the inorganic fine particles used in producing the toner in the example 5 was not used, and only the organic charge-controlling agent used in the example 5 was previously ground using a sand mill in the same manner as the example 5 and the organic charge-controlling agent thus ground was added to a dispersed system of the core particles in a proportion of 3 parts by weight to 100 parts by weight of a solid content of the core particles in the same manner as the example 5.

EXAMPLE 6

In this example, the types and the amounts of addition of the organic charge-controlling agent and the inorganic fine particles used in producing the toner in the abovementioned example 1 were changed.

In this example, as an organic charge-controlling agent, an organic charge-controlling agent composed of the same zinc salicylate metal complex as that used in the above-mentioned example 3 was used.

Furthermore, as inorganic fine particles, titanium oxide fine particles were used, which had a BET specific surface area of 22 $m^2/g$ and a particle diameter of 0.05 μm, and were obtained by spray-coating 100 parts by weight of hydrophilic titanium oxide (600B made by Teika K.K.) with a solution of 5 parts by weight of alkyl polysiloxane represented by the foregoing chemical formula [2] diluted with 50 parts by weight of xylene, followed by drying, heat treatment at 150° C. for two hours, and coating with alkyl polysiloxane and then, considerable crushing using a ultrasonic jet grinder.

Toner was produced in the same manner as the abovementioned example 1 except that 0.8 parts by weight of the above-mentioned organic charge-controlling agent and 0.8 parts by weight of the above-mentioned inorganic fine particles were added to 100 parts by weight of the core particles in the example 1.

EXAMPLE 7

In this example, as particles fixed to the surface of the core particles in the above-mentioned example 3, MMA/iBMA (1/9) polymer fine particles (MP-4951 made by Soken Kagaku K.K.) having an average particle diameter of 0.2 μm and having a glass transition temperature of 85° C. were used in addition to the organic charge-controlling agent obtained by grinding a zinc salicylate metal complex represented by the foregoing chemical formula [5] using a jet grinder and the inorganic fine particles comprising titanium dioxide surface-coated with alkyl polysiloxane represented by the foregoing chemical formula [2].

Toner was produced in the same manner as that in the above-mentioned example 3 except that 1.0 part by weight of a ground product of the above-mentioned zinc salicylate metal complex, 1.0 part by weight of the above-mentioned inorganic fine particles, and 15.0 parts by weight of the above-mentioned polymer fine particles were added to 100 parts by weight of the above-mentioned core particles, and their mixture was treated at a peripheral speed of 90 m/sec using Hybridization System (NHS-O type made by Nara Kikai Seisakusho K.K.).

The charging amount [μC/g] of each of the types of toner in the examples 1 to 7 and the comparative examples 1 to 5 produced in the above described manner and the amount of toner low in chargeability [% by weight] in the toner were then found, and the image quality was evaluated in a case where an image was formed using the toner.

In carrying out the evaluations, three types of carriers C1 to C3 produced in the following manner were used as carriers mixed with the types of toner.

A binder type carrier C1 having an average particle diameter of 55 μm was obtained by considerably mixing 100 parts by weight of polyester resin (NE-1110 made by Kao K.K.), 600 parts by weight of inorganic magnetic powder (MFP-2 made by TDK Corporation), and 2 parts by weight of carbon black (MA#8 made by Mitsubishi Chemical Industries, Ltd.) using Henschel Mixer and grinding them and then, fusing and thoroughly mixing them using an extrusion mixer having a cylinder portion set to 180° C. and a cylinder head portion set to 170° C., cooling and granulating their mixture and then, finely grinding the mixture using a jet mill, followed by air classification using a pneumatic classifier.

Furthermore, the carrier C2 having an average particle diameter of 50 μm was obtained by coating the surface of a ferrite carrier core (F-300 made by Powder Teck K.K.) with thermosetting silicone resin using a rolling fluidizing bath (Spiracota made by Okada Seikou K.K.).

Additionally, the carrier C3 having an average particle diameter of 51 μm was obtained by coating the surface of a ferrite carrier core (F-300 made by Powder Teck K.K.) with polyethylene using the surface polymerization coating process.

The above-mentioned carriers C1 to C3 were combined with the types of toner in the examples 1 to 7 and the comparative examples 1 to 5, as shown in the following table 1.

In finding the charging amount [μC/g] of each of the types of toner in the examples 1 to 7 and the comparative examples 1 to 5 and the amount of toner low in chargeability [% by weight] in the toner, the toner and any one of the above-mentioned carriers were combined with each other, as shown in the table 1. The carrier was added to the toner so that the weight ratio of the carrier to the toner is 5:95, and they were put in 50 cc of a polyethylene bottle and rotated at 120 rpm for thirty minutes by a rotating carriage, to prepare a developer.

Figure 2:
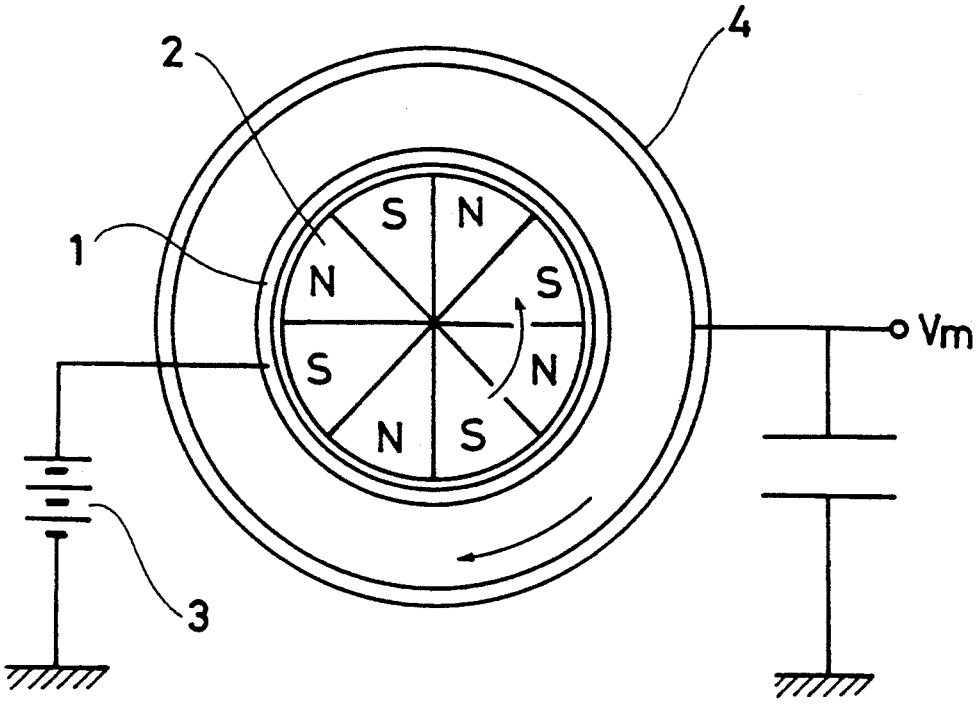
FIG. 2 is a schematic diagram for explaining a measuring equipment used for measuring the charging amount of toner and the amount of toner low in chargeability in the toner.

1 g of each of the developers thus prepared was weighed using a precision balance, to find the charging amount [μC/g] of each of the types of toner in the examples 1 to 7 and the comparative examples 1 to 5 and the amount of toner low in chargeability [% by weight] in the toner using an equipment shown in FIG. 2.

In measuring the charging amount [μc/g] of each of the types of toner using the equipment shown in FIG. 2, each of the developers weighed in the above described manner was so put as to be uniform on the entire surface of a conductive sleeve 1, and the rotational speed of a magnet roll 2 provided in the conductive sleeve 1 was set to 100 rpm.

A bias voltage of 3 kilovolts which is opposite in polarity to that of a toner charging potential was applied to the conductive sleeve 1 from a bias power supply 3, to rotate the above-mentioned conductive sleeve 1 for thirty seconds. A potential Vm in a cylindrical electrode 4 at the time point where the conductive sleeve 1 was stopped was read, and the toner adhering to the cylindrical electrode 4 from the conductive sleeve 1 was weighed using a precision balance, thereby to find the average charging amount [μc/g] of the toner. The results thereof are shown in the following table 1.

Furthermore, in measuring the amount of toner low in chargeability [% by weight] in each of the types of toner, no bias voltage was applied to the conductive sleeve 1 to ground the conductive sleeve 1. In this state, measurements were made in the same manner as described above to determine what amount of the toner put on the conductive sleeve 1 is flown to the cylindrical electrode 4, thereby to find the amount of toner low in chargeability [% by weight] in the toner. The results thereof are shown in the following table 1.

Additionally, in evaluating the image quality in a case where each of the types of toner in the examples 1 to 7 and the comparative examples 1 to 5 was used to form an image, each of developers obtained by combining the types of toner in the examples 1 to 7 and the comparative example 1 to 5 with the carriers in the above described manner was used.

A commercially available copying machine (EP-570Z made by Minolta Camera Co., Ltd.) was used as an apparatus used in evaluating the image quality by the use of the developers using the types of toner in the examples 1 to 3, 6 and 7 and the comparative examples 1 to 3, a commercially available copying machine (EP-470Z made by Minolta Camera Co., Ltd.) was used as an apparatus used in evaluating the image quality by the use of the developers using the types of toner in the example 4 and the comparative example 4, and the abovementioned copying machine (EP-570Z made by Minolta Camera Co., Ltd.) having a fuser improved to be one of an oil coating type was used in evaluating the image quality by the use of the developers using the types of toner in the example 5 and the comparative example 5.

Each of the developers using the types of toner in the examples 1 to 7 and the comparative examples 1 to 5 was used for each of the above-mentioned copying machines. This copying machine carried out image formation using a chart having a 6 percent black and evaluated the image quality of an image formed in the early stages. In addition, the copying machine using the developers using the types of toner in the examples 1 and 2 and the comparative examples 1 and 2 evaluated the image quality of an image formed after doing printing on 10000 paper sheets.

In the following table 1, as the evaluations of the image quality, O indicates a case where the image formed is not fogged and thus, good, Δ indicates a case where the image is slightly fogged but is practically usable, and X indicates a case where the image is significantly fogged and thus, is practically a problem.

TABLE 1

| | carrier | average charging amount μC/g | amount of toner low in chargeability % by weight | image evaluation initial | image evaluation 10000 |
|---|---|---|---|---|---|
| Example 1 | C1 | −23 | 0.6 | O | — |
| Comparative Example 1 | C1 | −22 | 11.2 | X | — |
| Example 2 | C2 | −20 | 0.5 | O | O |
| Comparative Example 2 | C2 | −21 | 9.8 | Δ | X |
| Example 3 | C3 | −24 | 0.4 | O | O |
| Comparative Example 3 | C3 | −21 | 9.3 | Δ | X |
| Example 4 | C1 | +18 | 0.8 | O | — |
| Comparative Example 4 | C1 | +16 | 8.6 | X | — |
| Example 5 | C2 | −21 | 0.7 | O | — |
| Comparative Example 5 | C2 | −18 | 11.5 | X | — |
| Example 6 | C2 | −20 | 0.2 | O | O |
| Example 7 | C3 | −22 | 0.8 | O | O |

As apparent from the results, in a case where each of the types of toner in the above-mentioned examples 1 to 7 is used, the amount of toner low in chargeability is significantly smaller and the amount of fogging in the image formed is smaller, to obtain a better image, as compared with a case where each of the types of toner in the comparative examples 1 to 3 is used.

Furthermore, with respect to the types of toner in the above-mentioned example 5 and the comparative example 5, an image was formed on an OHP sheet using the above-mentioned copying machine, the image fixed on the OHP sheet was projected using an OHP projector, and the brightness of color in a projected image obtained was visually evaluated. As a result, even when either one of the types of toner was used, the image formed was practically usable in terms of color reproducibility.

Although the present invention has been described and illustrated in detail, it is clearly understood that the same is by way of limitation, the spirit and scope of the present invention being limited only by the terms of the appended claims.

What is claimed is:

1. Toner for developing an electrostatic latent image, in which at least an organic charge-controlling agent having a BET specific surface area of 15 to 80 $m^2/g$ and inorganic fine particles having a BET specific surface area of 10 to 150 $m^2/g$ are fixed and/or film-formed in a uniformly dispersed state on the surface of core particles mainly composed of thermoplastic resin.

2. The toner for developing an electrostatic latent image according to claim 1, wherein the BET specific surface area (A) of said organic charge-controlling agent and the BET specific surface area (B) of said inorganic fine particles satisfy the relationship $\frac{1}{3} \leqq B/A \leqq 5$.

3. The toner for developing an electrostatic latent image according to claim 1, wherein the BET specific surface area of said organic charge-controlling agent is 20 to 600 $m^2/g$.

4. The toner for developing an electrostatic latent image according to claim 1, wherein the amount of said organic charge-controlling agent used is 0.01 to 10 parts by weight per 100 parts by weight of said core particles.

5. The toner for developing an electrostatic latent image according to claim 1, wherein the weight ratio of said organic charge-controlling agent to said inorganic fine particles is $\frac{1}{4}$ to 4.

6. The toner for developing an electrostatic latent image according to claim 1, wherein the average particle diameter of said core particles is not more than 10 μm.

7. The toner for developing an electrostatic latent image according to claim 1, wherein thermoplastic resin fine particles, together with said organic charge-controlling agent and said inorganic fine particles, are fixed or filmformed on the surface of said core particles.

8. Light-transmittable toner for developing an electrostatic latent image, in which at least a calixarene compound having a BET specific surface area of 15 to 80 $m^2/g$ and inorganic fine particles having a BET specific surface area of 10 to 150 $m^2/g$ are fixed and/or film-formed in a uniformly dispersed state on the surface of core particles mainly composed of linear polyester having a number-average molecular weight Mn of 2000 to 15000 and having a molecular-weight distribution (Mw/Mn) of not more than 3.

9. The light-transmittable toner for developing an electrostatic latent image according to claim 8, wherein said inorganic fine particles are coated with alkyl polysiloxane.

10. The light-transmittable toner for developing an electrostatic latent image according to claim 9, wherein said alkyl polysiloxane has active hydrogen.

11. The light-transmittable toner for developing an electrostatic latent image according to claim 8, wherein the BET specific surface area of said calixarene compound is 20 to 60 $m^2/g$.

12. Toner for developing an electrostatic latent image, which is produced by mixing core particles mainly composed of thermoplastic resin, an organic charge-controlling agent having a BET specific surface area of 15 to 80 $m^2/g$ and inorganic fine particles having a BET specific surface area of 10 to 150 $m^2/g$ with each other, causing said organic charge-controlling agent and said inorganic fine particles to uniformly adhere to the surface of said core particles and then, fixing and/or film-forming said organic charge-controlling agent and said inorganic fine particles in a uniformly dispersed state on the surface of said core particles by a surface treating equipment.

13. The toner for developing an electrostatic latent image according to claim 12, wherein said surface treating equipment for fixing or film-forming said organic charge-controlling agent and said inorganic fine particles on the surface of said core particles uses a process selected from the impact process in a high speed air current, the dry mechanochemical process, the modification process in a hot air current and the wet coating process.

14. Toner for developing an electrostatic latent image, which is produced by mixing core particles mainly composed of thermoplastic resin produced by the wet granulating process, an organic charge-controlling agent having a BET specific surface area of 15 to 80 $m^2/g$, and inorganic fine particles having a BET specific surface area of 10 to 150 $m^2/g$ with each other and then, causing their mixture to aggregate and crushing an aggregate obtained by a surface treating equipment having a crushing function and at the same time, fixing said organic charge-controlling agent and said inorganic fine particles on the surface of the core particles.

15. The toner for developing an electrostatic latent image according to claim 14, wherein said core particles contain polyolefin wax having a number-average molecular weight of 1000 to 20000 and having a softening point of 80° to 150° C.

* * * * *